US006196244B1

(12) United States Patent
Haddad et al.

(10) Patent No.: US 6,196,244 B1
(45) Date of Patent: Mar. 6, 2001

(54) CONFIGURABLE UMBRELLA

(76) Inventors: Joseph R. Haddad, 18 Powder Horn Way; David A. Smith, 72 Delmore Ave., both of Berkeley Heights, NJ (US) 07922

( * ) Notice: Subject to any disclaimer, the term of this patent is extended or adjusted under 35 U.S.C. 154(b) by 0 days.

(21) Appl. No.: 09/233,637

(22) Filed: Jan. 19, 1999

(51) Int. Cl.[7] ..... A45B 25/00

(52) U.S. Cl. ..... 135/29; 135/31; 135/32; 135/33.2

(58) Field of Search ..... 135/29, 31, 32, 135/332, 33.5, 33.6, 44

(56) References Cited

U.S. PATENT DOCUMENTS

| | | | |
|---|---|---|---|
| 4,641,675 | | 2/1987 | Wu . |
| 4,711,260 | | 12/1987 | Wiens et al. . |
| 4,838,290 | | 6/1989 | Wu . |
| 5,226,438 | * | 7/1993 | Dubinsky ..... 135/33.4 |
| 5,307,827 | | 5/1994 | Haddard et al. . |
| 5,355,903 | | 10/1994 | Haddad et al. . |
| 5,505,221 | | 4/1996 | Gao . |
| 5,564,453 | * | 10/1996 | Steiner ..... 135/98 |
| 5,611,364 | * | 3/1997 | Woods ..... 135/21 |
| 5,800,004 | | 9/1998 | Ackeret . |

FOREIGN PATENT DOCUMENTS 0372882 11/1939 (IT) .

* cited by examiner

*Primary Examiner*—Beth A. Stephan
(74) *Attorney, Agent, or Firm*—Mathews, Collins, Shepherd & Gould, P.A.

(57) ABSTRACT

The present invention relates to umbrellas having various canopy shapes which shapes can be altered during use. A multiple position rib formed of a telescoping rib girder in combination with a hub slide assembly with multiple hubs allow the umbrella to be opened to two or more functional positions. An embodiment is an umbrella that can be used as a car shade having two open canopy configurations. In a first open position, all multiple position ribs are in an extended position so that the umbrella serves as a conventional rain umbrella. In a second open position, at least one of the multiple position ribs is folded to allow the umbrella to fit inside a vehicle windshield thereby serving as a sun shade. The multiple position rib can be formed of a rigid inner support assembly and a flexible outer cantilevered assembly. Flex strength properties of the outer cantilevered assembly can be varied within a rib and between ribs to provide a stable frame for certain unconventionally shaped umbrellas, including domes with flattened centers, asymmetric rib configurations, and ribs of differing lengths. Flex strength properties of the outer cantilevered assembly can be also varied to increase the flexibility of rib ends without compromising open canopy integrity. On contact rib ends can bend down toward the pole altering the shape of the canopy perimeter. The rib ends can return to their original positions when contact is terminated.

17 Claims, 10 Drawing Sheets

CONFIGURABLE UMBRELLA

BACKGROUND OF THE INVENTION

1. Field of the Invention

This invention relates to a configurable umbrella which can be converted into different shapes having a rib assembly which includes a rigid portion and a flexible portion that provides non-uniform flex strength of the ribs.

2. Description of the Related Art

A conventional umbrella typically has a cloth covered, dome shaped canopy that is symmetrical to a central pole and is supported by ribs that are secured to the pole and radiate outward. The ribs are evenly spaced around the pole and their cantilevered outer portions are equally flexed. Each rib is exactly the same and all are operated in unison via a single slide on the pole. In operation the umbrella is opened to its functional configuration or closed for storage by collapsing the ribs against the pole.

Conventional ribs of an umbrella have the same flex strength since each rib is formed of the same material and construction. The cantilevered portion of a conventional rib is composed of one material and is constructed with uniform thickness throughout its length. Thus, the flex strength of any rib is uniform throughout its cantilevered length. Accordingly, all conventional ribs share a common curvature profile when pressure is applied along the rib length. The curvature rate peaks in the first third of the distance from the fixed end to the free end, declines almost to zero in the middle third, and the third nearest the free end is essentially straight.

An open conventional canopy holds its intended shape since each rib of the umbrella is flexed in the same manner, the canopy is symmetrical to the pole, the cantilevered portions are the same length and the canopy cover is contoured to fit the flexed ribs. When these conditions are met the restraining force of the fabric and the restoring force of the flexed ribs can be sufficiently in equilibrium throughout the canopy to hold its shape. Conventional umbrellas have the shortcoming that if any of the above-described conditions are not met the ribs will not fit the fabric contour because they will seek equilibrium outside their intended positions, and the canopy will not hold its shape.

U.S. Pat. No. 5,505,221 describes a modification to the typical dome configuration of an umbrella with off-center support. The umbrella is symmetrical along a central vertical plane rather than the pole. Ribs of differing lengths are used to form a canopy having an elongated dome. A similarly shaped umbrella is described in Italian patent number 0372882. U.S. Pat. No. 4,838,290 describes a hat shaped umbrella with asymmetric properties, having cantilevered rib portions of differing lengths.

U.S. Pat. Nos. 5,307,827 and 5,355,903 issued to one of the inventors of this disclosure describe a dual function asymmetric umbrella. The primary embodiment of these patents is an umbrella in which the configuration can be altered to form a shade for auto windshield interiors. Ribs are unevenly spaced around the pole having cantilevered portions of differing lengths. The canopy has a flattened center in order to fit against a windshield and does not have a conventional dome shape.

In the closed position all ribs of the dual function umbrella are folded against a collapsed pole. From the closed position the umbrella can be opened and latched in either of two positions, each producing a different canopy configuration. In one open position, some of the ribs are partially extended and some are fully extended causing the canopy configuration to be approximately rectangular so it can be placed against the inner surface of a vehicle windshield as a shade. In the other open position all ribs are fully extended to produce an oval canopy to function as a conventional rain umbrella. The ribs that can be either partially or fully extended are referred to as "multiple position ribs." Their outer portion can be extended or folded by moving two slides on the pole. The other ribs are conventionally constructed and operated. The multiple position rib inner portion supports and controls the outer flexible portion using a push bar that runs the length of a girder from the pole to a piston housed at the other end of the girder. The piston is connected to the rib by a hinge. The above-described dual function umbrella has several shortcomings such as: the multiple position rib has a limited range of motion; the multiple position rib lacks the rigidity to hold a fully extended rib firmly in place; the use of multiple position ribs and conventional ribs in the same umbrella causes canopy surface unevenness; push bars used in the multiple position rib are vulnerable to damage; when the umbrella is to be used as a car shade four ribs are fully opened to extend the canopy horizontally which makes it difficult to place against the windshield if the entire upper surface of the dashboard is not flat; and the rib construction poses a sizing problem for the car shade umbrella in that one size umbrella fits a limited number of vehicles and is either too large or too small for most windshields.

Conventional rib construction causes the rib tips of umbrellas to be inflexible and therefore hazardous when the canopy is being opened or is in use. It is well known that the rib tips can cause eye and other injuries. This disadvantage has always been considered inherent to umbrellas and inescapable.

It is desirable to provide an umbrella which can be varied in shape and provide improved stability, safety and reduced vulnerability to damage.

SUMMARY OF THE INVENTION

The present invention provides a range of umbrella shapes and configurations for increasing umbrella utility and safety. The umbrella includes rib assemblies each formed of an inner support assembly attached to an outer cantilevered assembly. The inner support assembly is rigid and the outer cantilevered assembly is flexible. The cantilevered assembly can have non-uniform flex strength. The umbrella can include a plurality of multiple position ribs and single position ribs each formed of the rib assembly extending radially from a pole. The multiple position ribs can be secured in either an extended or folded position when the umbrella is in use and the remaining single position ribs are extended.

The present invention provides rib assemblies with varied cantilevered rib flex strength within a rib or from rib to rib as needed to produce equilibrium between the restoring force of the ribs and the restraining force of the umbrella's canopy cover. It has been found that in asymmetrical shaped canopies the restraining force of the cover against the flexed ribs is not uniform along the length of a rib or from rib to rib. Accordingly, the flex strength of conventional ribs is not able to hold the asymmetrical shaped canopy cover in its intended shape.

The flex strength profile of each rib of an umbrella required for canopy equilibrium is a function of the canopy cover's stretch properties and the desired shape of the canopy. The present invention includes rib assemblies including outer cantilevered portions having flex strength profiles to achieve the following configurations: umbrellas with asymmetric domes in which flex strength profile varies between ribs; flattened or spherical dome shaped umbrellas in which the required curvature of a rib is constant or increases with distance from the fixed end; and umbrellas with soft rib tips in which flex strength is reduced at the rib ends while rib to fabric equilibrium is maintained in the rest of the canopy.

Flex strength properties that change along the length of a rib are achieved by changing the cross sectional characteristics along its cantilevered length, or by using multiple materials to form the cantilevered portion. More specifically, the cantilevered rib portions can be formed of a graduated or tapered cross sectional area of a rib formed of a single material; a rib formed in at least two segments with each segment having a different cross sectional area; a rib formed in segments with each segment formed of a material of different flex strength; and a rib formed in segments with at least one segment having a different cross sectional profile, such as that of a coiled or flat spring.

The structure of a multiple position rib allows the umbrella to be capable of at least two open positions. The multiple position rib includes a two-part telescoping girder to strongly support a hinged outer cantilevered portion of the rib. The multiple position rib is controlled by a hub slide assembly moveable on the umbrella pole. Compared to the multiple position ribs described in U.S. Pat. Nos. 5,307,827, and 5,355,903, the present invention has the advantages of reducing the number of parts, holding the ribs more firmly, allowing the ribs to be controlled through a greater range of motion, and allowing the ribs to be subjected to less damage.

Conventionally, the ribs of an umbrella fold toward the pole. The folded outer portion of a rib normally points toward the pole. However if only some ribs of an umbrella are partially folded while the others remain fully extended, the canopy cover will restrict and alter the direction of the folding portions which can bend the ribs. In the present invention, the outer portion of the multiple position rib is hinged to a swiveling pivot joint to allow the rib to be partially folded while others remain fully extended.

The present invention allows the umbrella to be latched temporarily while partially open. This permits the operator to position the umbrella on a dashboard so that the single position ribs are free to open fully against the windshield. A latched partially open position also affords a person leaving a vehicle more immediate rain protection than otherwise possible.

The rib construction of the present invention also provides increased rib tip flexibility without compromising overall stability. Flexible rib ends have the advantages of the ability to compress temporarily part of the umbrella's perimeter surface area, thereby an umbrella can be opened in doorways too narrow for conventional umbrellas, the ability for allowing the user to avoid opening the umbrella in the rain; the ability of its flexible rib ends to bend on contact with the door's frame and remain clear of the door path, since if they do not encounter the door's frame they will assume their intended shape in the windshield; and the ability to flex when contacting a person or object which is especially beneficial in confined or crowded areas such as busy sidewalks for improved safety. Accordingly, the umbrella construction makes it possible for one size to fit most windshields. In addition, the umbrella has the advantage that persons seated next to one another in an open stadium can fold a portion of the umbrellas to allow the umbrellas to be used without intruding on each other.

Umbrellas are widely used as promotional items. Corporations and other organizations purchase umbrellas with their name or logo imprinted on the canopy cover and redistribute them as a means of advertising. The present invention enhances the promotional value of umbrellas because flattened canopy surface areas provide a larger viewable area for logos and other promotional art than conventionally domed surfaces. This is especially true for using the umbrella as a car shade because its flattened surface is readily and fully viewable not only when it is in use as a rain umbrella but also when it is used as a car shade.

These and other features of the invention can be further understood with reference to the following drawings.

DETAILED DESCRIPTION OF THE PREFERRED EMBODIMENTS

During the course of this description like numbers will be used to identify like elements according to the different figures which illustrate the invention.

FIGS. 1–8 illustrate an umbrella having a flattened canopy surface with two open positions and a closed position which can be used as a modified car shade in accordance with the teachings of the present invention. The umbrella includes at least one multiple position rib and at least one single position rib. Alternately, the umbrella can be formed of all multiple position ribs. FIGS. 7A–7B show a top and side view of a first open position in which all multiple position ribs are extended. The umbrella in this position takes the form of a conventional umbrella. FIGS. 8A–8B show a top and side view of a second open position in which the single position ribs are fully extended and the multiple position ribs are partially extended. In the second open position, the single position ribs extend laterally and the multiple position ribs extend vertically. The umbrella in this form takes the form of a shade screen. The canopy can have a desired canopy shape such as a quadrilateral, rectangle or trapezoid so that the shade screen can fit readily against the inner surface of a vehicle windshield. In the closed position all ribs are folded against a pole of the umbrella.

Figure 1:
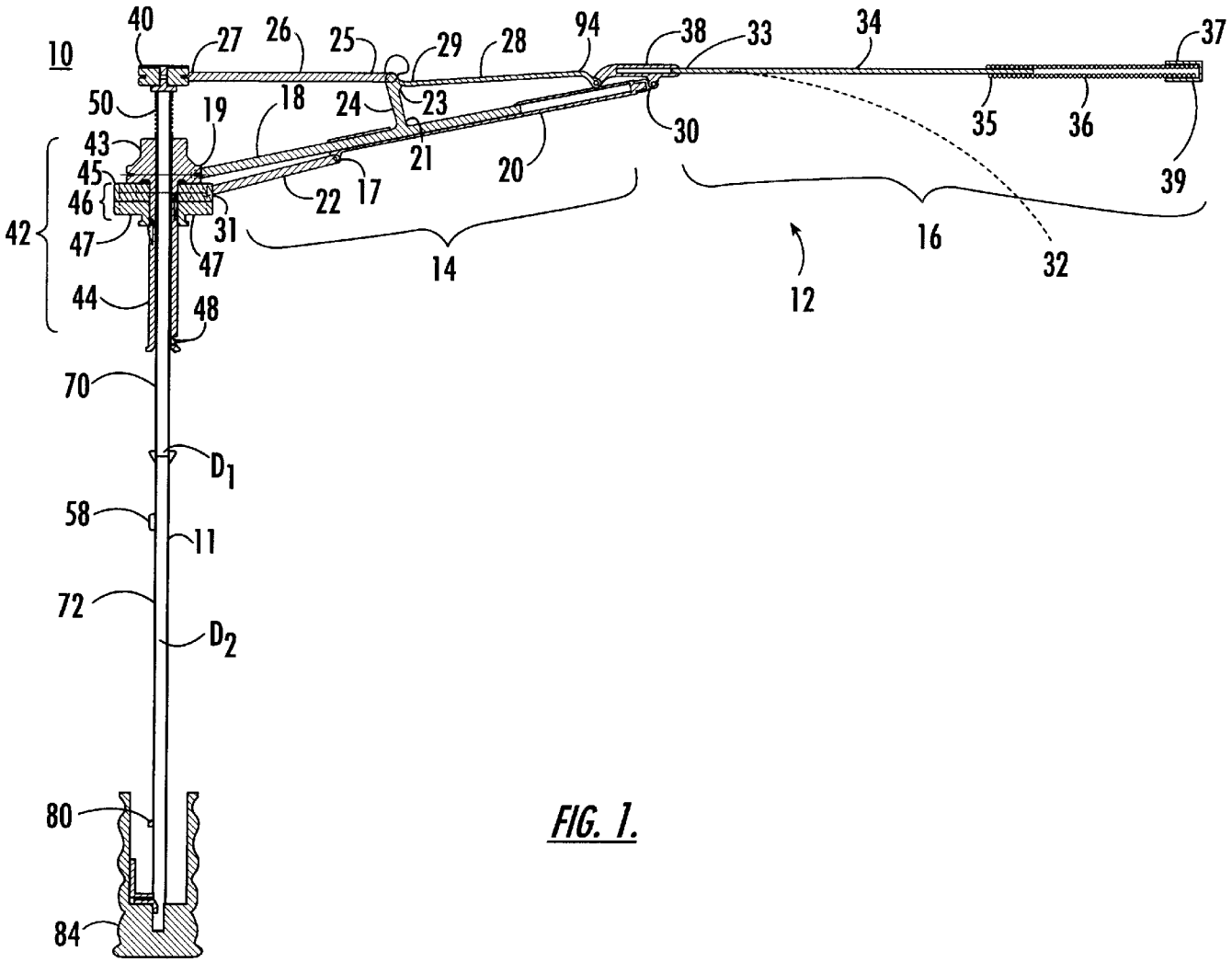
FIG. 1 is a cross sectional view of the umbrella of the present invention which can be used as a vehicle shade showing a cut away pole and hub slide assembly with one multiple position rib without a canopy cover. The umbrella is open and the rib is extended in an open position.

FIG. 1 illustrates umbrella 10 comprising pole 11 and multiple position rib assembly 12. Multiple position rib assembly 12 comprises inner support assembly 14 and outer cantilevered assembly 16. Inner support assembly 14 has a rigid structure and outer cantilevered assembly 16 has a flexible structure. Inner support assembly 14 comprises girder rod 18, girder sleeve 20, control strut 22, link hinge 24, beam 26, link rod 28 and swivel pivot joint 30. Girder sleeve 20 is moveable to be telescoping with girder rod 18. Girder sleeve 20 is slotted to receive link hinge 24. Girder sleeve 20 is connected to control strut 22 with pivot 17.

Link hinge 24 connects girder rod 18 to beam 26. End 21 of link hinge 24 is pivotally connected to girder rod 18. End 25 of beam 26 is pivotally connected to end 23 of link hinge 24. End 25 of beam 26 is also pivotally connected to link rod 28.

Outer cantilevered assembly 16 comprises inner rib section 34, outer rib section 36, rib hinge 38 and end cap 39. End 33 of inner rib section 34 is attached to rib hinge 38. End 35 of inner rib section 34 is attached to outer rib section 36. Preferably, outer rib section 36 is formed of a coil spring. Upon contact with an object (not shown), outer rib section 36 bends towards pole 11, thereby altering the shape of outer cantilevered assembly 16 and a canopy (not shown) attached thereto. After contact is terminated, outer rib section 36 returns to its original position. Inner rib section 34 can be formed of a larger cross section area than outer rib section 36 for changing the flex strength along the length of outer cantilevered assembly 16. Alternately, the inner rib section 34 and cantilevered section 36 can be integral formed as a single tapered rib.

End cap 39 fits over end 37 of outer rib section 36. End cap 39 can be formed of a resilient material.

Figure 2A:
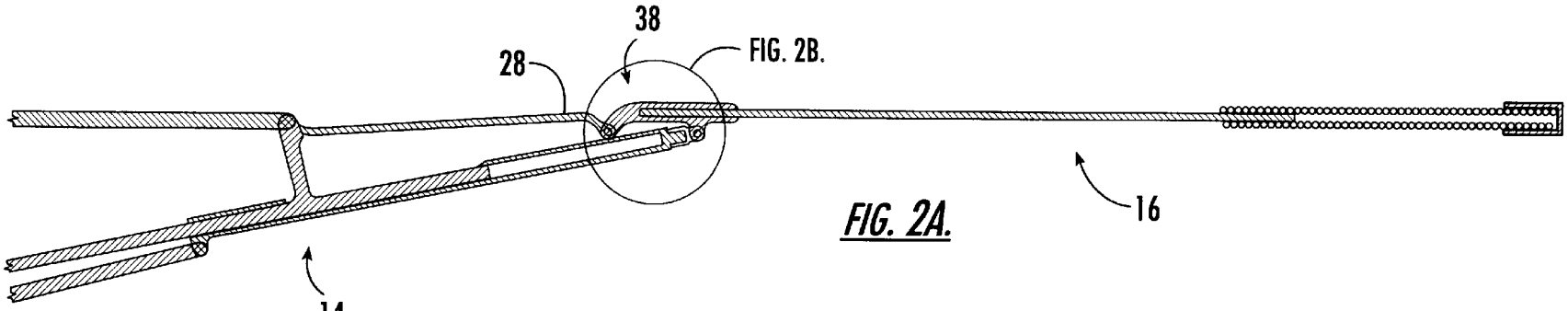
FIG. 2 is an exploded side view of a swivel joint and assembly shown in FIG. 1.
Figure 2B:
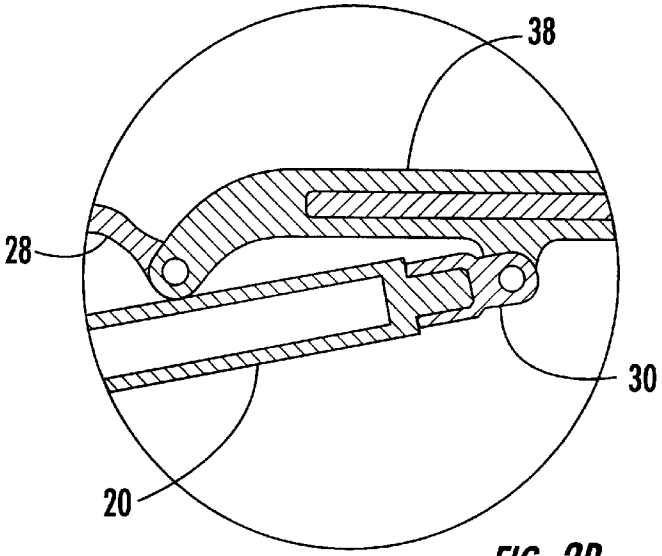

Rib hinge 38 is pivotally attached to link rod 28 as shown in FIG. 2. Rib hinge 38 is also pivotally attached with swivel pivot joint 30 to girder sleeve 20. Swivel pivot joint 30 swivels rib hinge 38 and girder sleeve 20.

Beam 26 is perpendicular to pole 11 when umbrella 10 is in the first open position, as shown in FIG. 1. Since FIG. 1 excludes a canopy cover, inner support assembly 14 and outer cantilevered assembly 16 form a straight line perpendicular to pole 11 as it would prior to attaching the canopy cover. In this first open position, rib hinge 38 rests on girder sleeve 20 for rigidity to help prevent canopy inversion in high wind conditions.

Broken line 32 shown in FIG. 1 illustrates a curvature profile of outer cantilevered assembly 16 when attached to a fabric canopy cover (not shown). The rate of curvature of broken line 32 increases with distance from the secured end of outer cantilevered assembly 16 which comprises inner rib section 34 attached to rib hinge 38. Preferably, inner rib section 34 is tapered to have a smaller width as the distance increases from rib hinge 38 for providing flex strength that decreases with distance from rib hinge 38 in order to achieve equilibrium with the restraining force of the canopy fabric. The flex strength profile of each rib of an umbrella required for canopy equilibrium is a function of the canopy cover's stretch properties and the desired shape of the canopy.

In an alternate embodiment, inner rib section 34 is formed of a different material than the material used for outer rib section 36. Preferably, inner rib section 34 is formed of a material having greater flex strength than the material of the outer rib section 36. For example, inner rib section 34 can be formed of a nylon material filled with glass fibers or other stiffening fillers and outer rib section 36 can be formed of unfilled nylon.

Figure 3A:
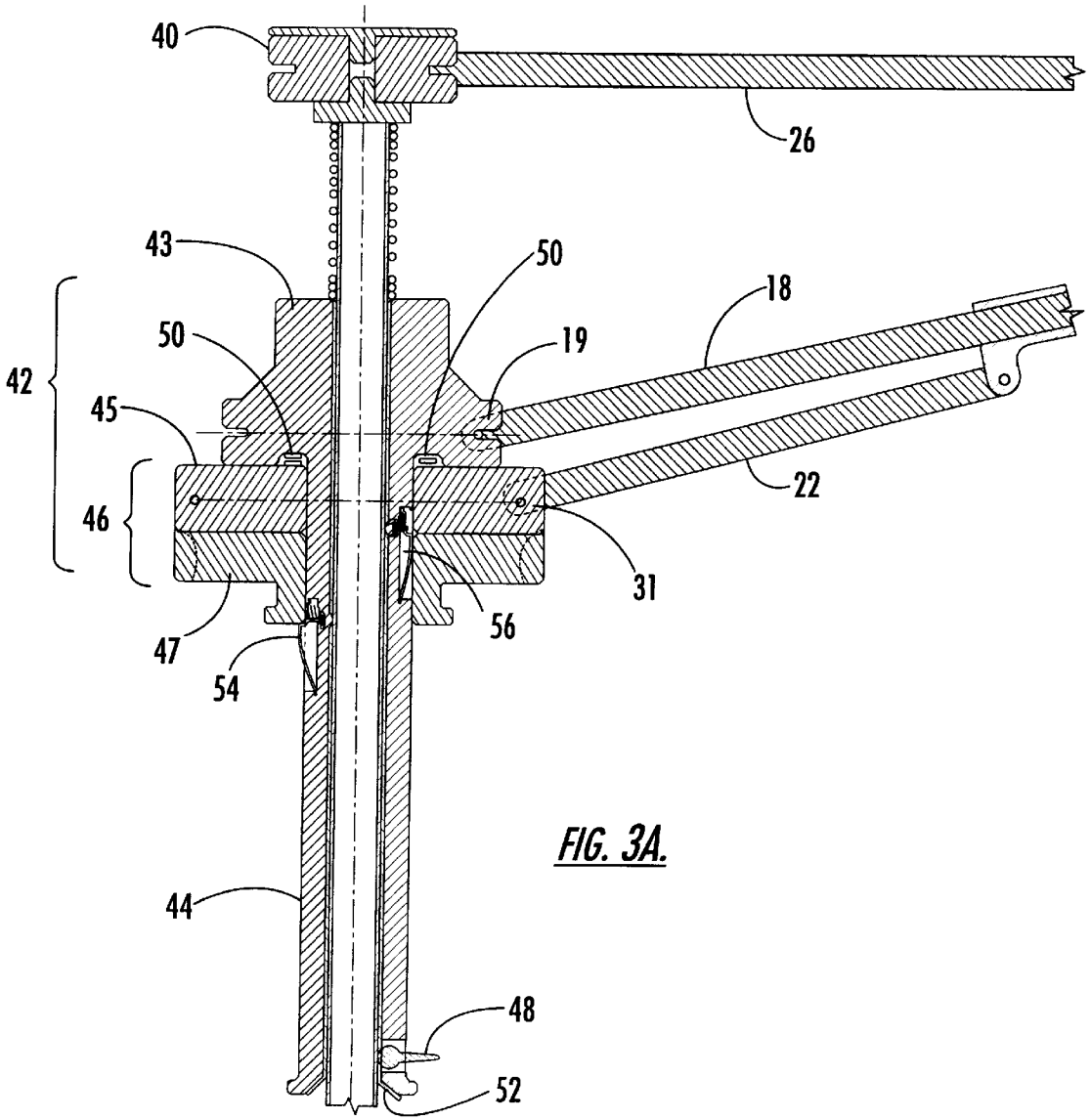
FIG. 3A is a perspective view of the hub slide assembly shown in FIG. 1, the upper and lower sections of split hub are adjacent to one another.
Figure 3B:
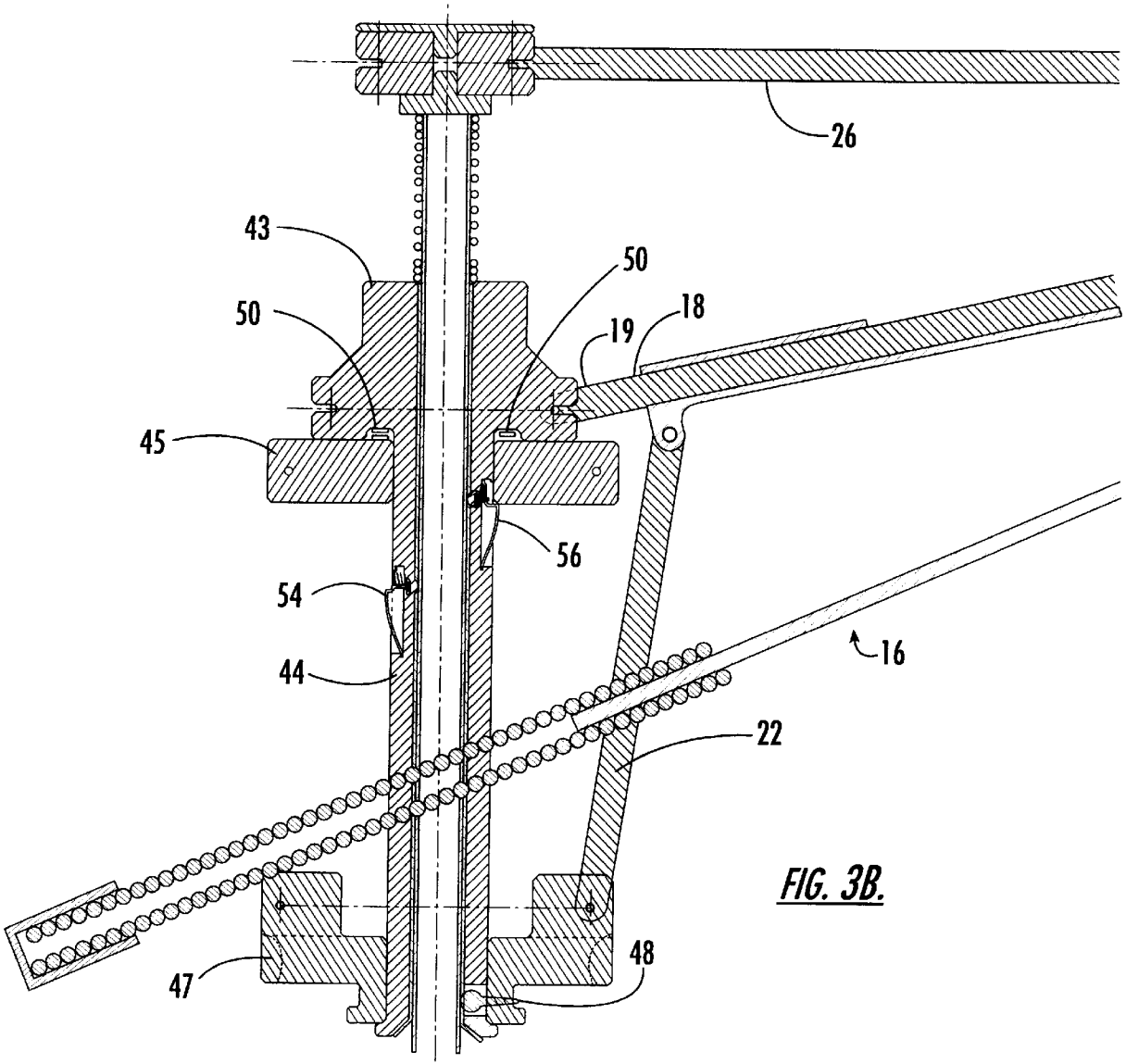
FIG. 3B is a perspective view of a the hub slide assembly shown in FIG. 1, the upper and lower sections of the split hub are separated.
Figure 3C:
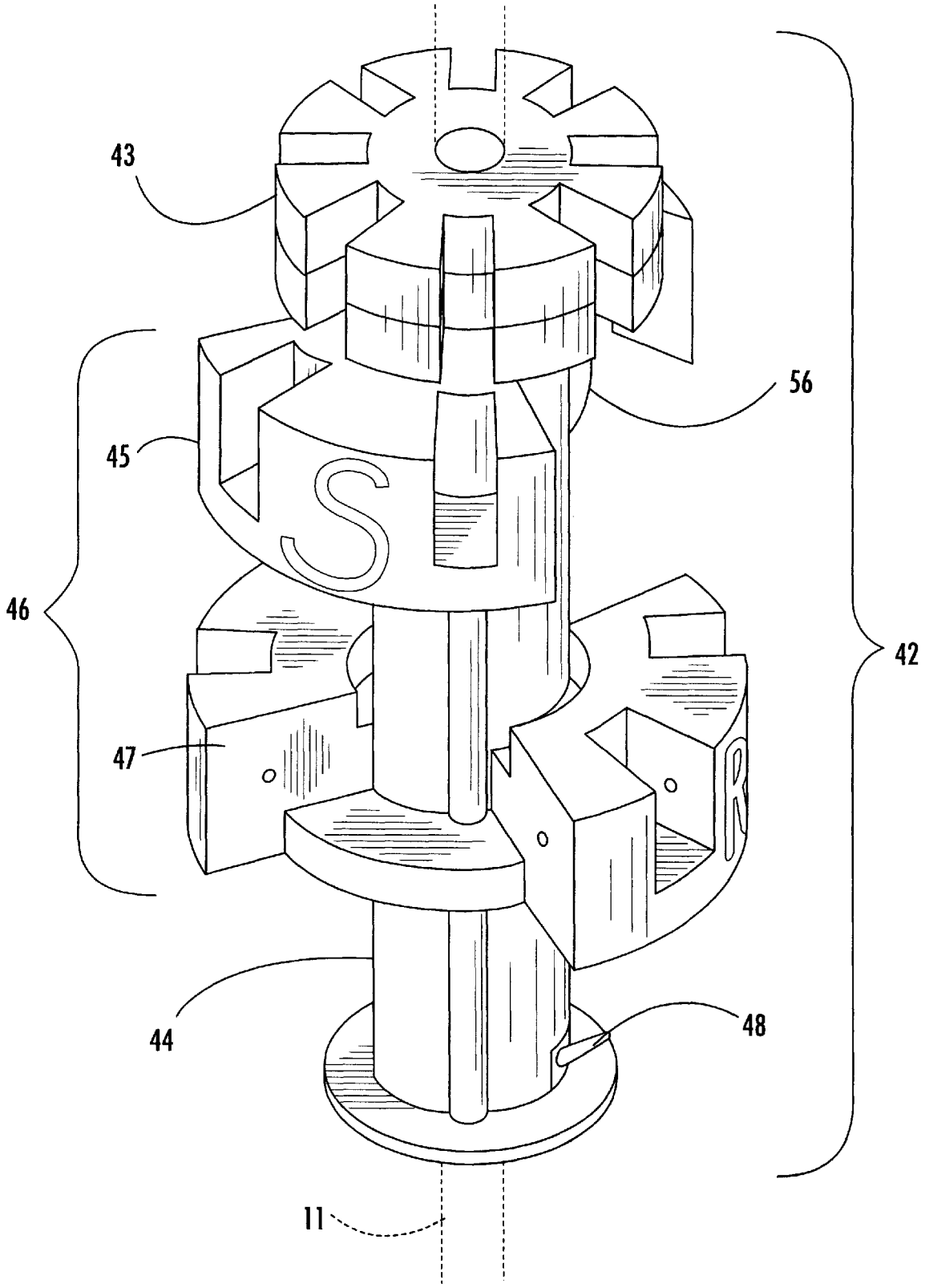
FIG. 3C is a perspective view of the hub slide assembly shown in FIG. 1.

Inner support assembly 14 is coupled to fixed hub 40 and hub slide assembly 42. End 27 of beam 26 is pivotally connected to pole 11 by fixed hub 40. As illustrated in FIGS. 3A–3C, hub slide assembly 42 is comprised of base hub 43, base hub shaft 44, split hub 46, base hub toggle lock 48, hub separator spring 50, sleeve 52, and two split hub leaf latch assemblies 54, 56. Hub slide assembly 42 slides along the pole 11. Split hub 46 slides along base hub shaft 44. End 19 of girder rod 18 is pivotally connected to base hub 43. Split hub 46 is comprised of upper section 45 and lower section 47. Lower section 47 of split hub 46 is pivotally attached to end 31 of control strut 22 of multiple position rib assembly 12. Sleeve 52 preferably is formed of a steel lining and provides for hub slide assembly 42 to interface with pole 11.

Base hub toggle lock 48 secures hub slide assembly 42 at any position along pole 11 when base hub toggle lock 48 is extended horizontally. Movement of base hub toggle lock 48 upward or downward from the horizontal against base hub shaft 44 disengages hub slide assembly 42 to allow movement of hub slide assembly 42. Hub separator spring 50 is positioned between upper section 45 of split hub 46 and base hub 43. Hub separator spring 50 accelerates the downward movement of upper section 45 when upper section 45 is unlatched. Hub separator spring 50 compresses when upper section 45 is latched.

Figure 5:
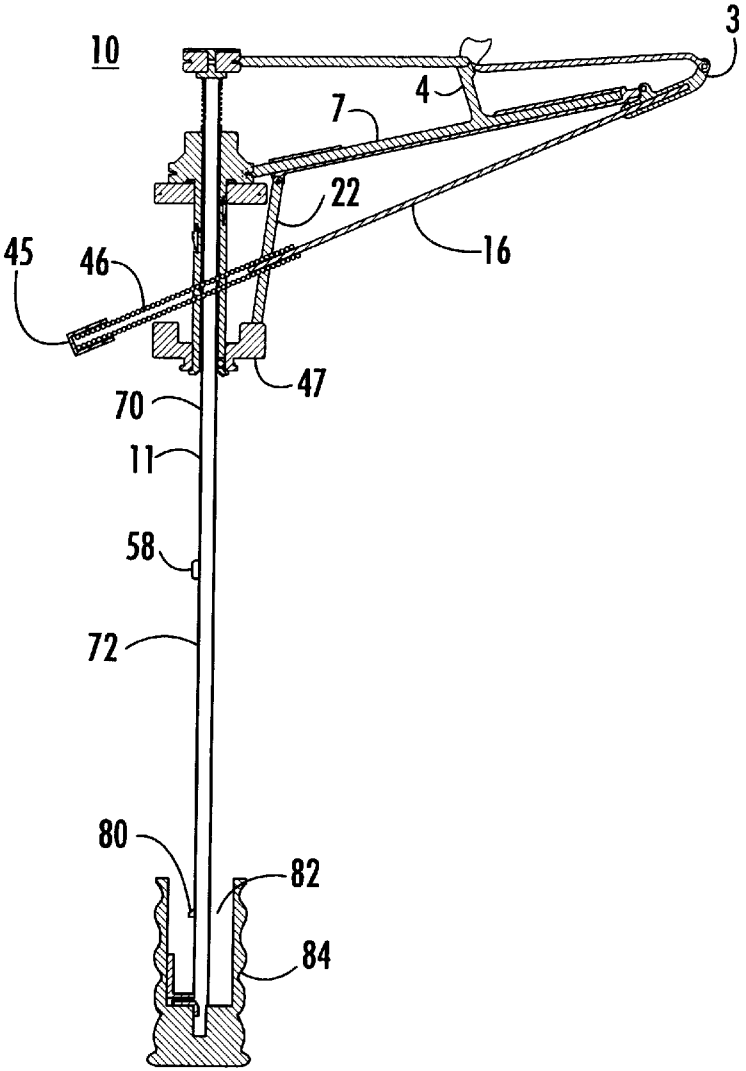
FIG. 5 is a cross-sectional view of the umbrella when the umbrella is in a second open position wherein a multiple position rib is in a folded position.

The position of lower section 47 of split hub 46 on base hub shaft 44 determines whether the umbrella 10 opens to either the first open position shown in FIG. 1 or the second open position shown in FIG. 5. In the first open position, lower section 47 of split hub 46 is secured adjacent to upper section 45 of split hub 46, as shown in FIG. 3A. In the second open position, lower section 47 of split hub 46 is separated from upper section 45 of split hub 46, as shown in FIG. 3B. When lower section 47 is secured at the top of base hub shaft 44 with leaf latch 54 while the umbrella is opening umbrella 10 is placed in the first open position in which multiple position rib assemblies 12 are fully extended. When lower section 47 is not secured at the top of base hub shaft 44, umbrella 10 is placed in the second position with multiple position rib assemblies 12 in a folded position when the umbrella 10 is opened.

Figure 4:
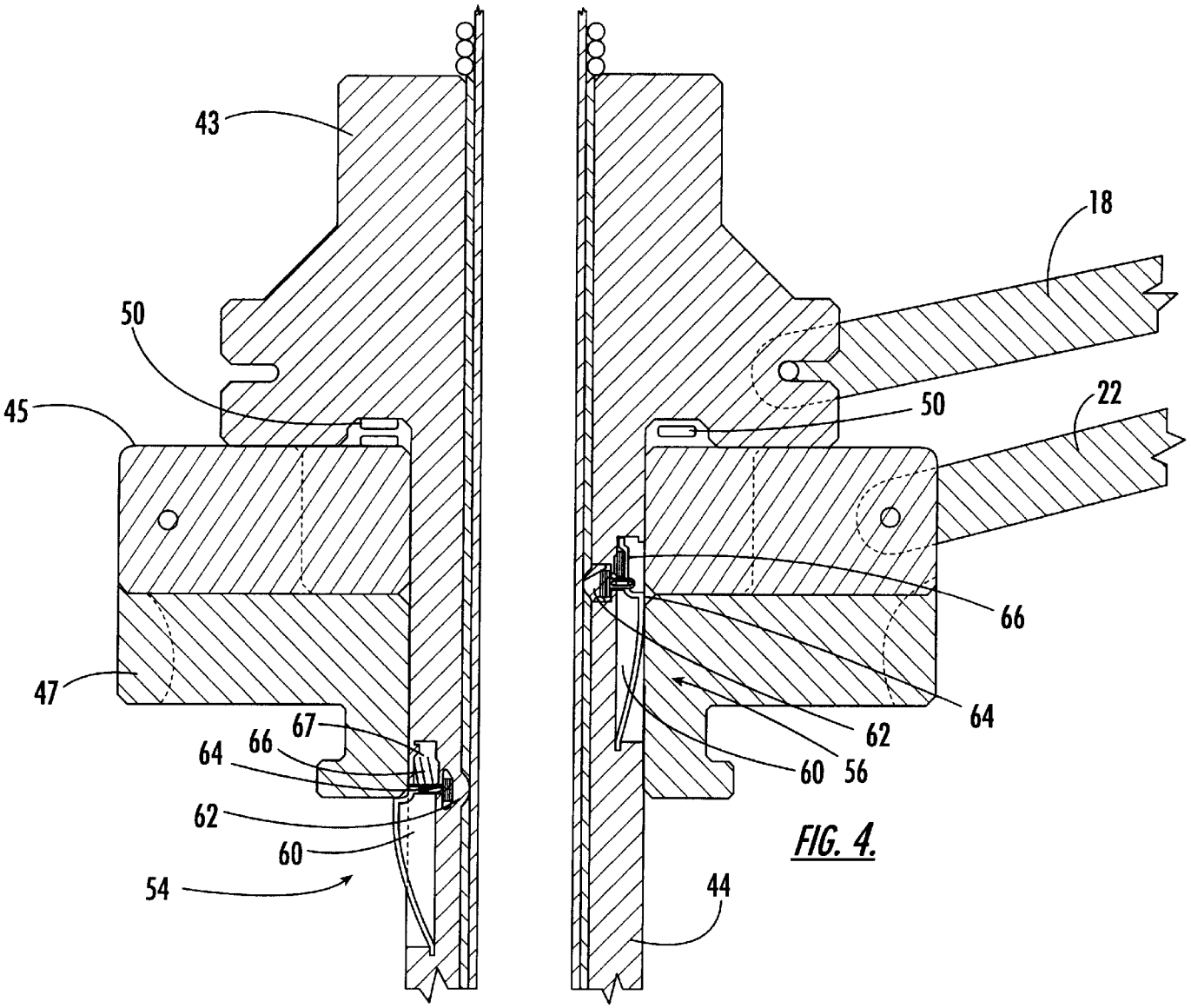
FIG. 4 is a cut away view of two hub slide leaf latches of the split hub slide when the umbrella is in a first open position.

Split hub leaf latch assemblies 54 and 56 are used respectively to latch and unlatch lower section 47 of split hub 46 and upper section 45 of split hub 46. Referring to FIG. 4, each split hub leaf latch assembly 54, 56 comprises leaf spring 60, plunger 62, plunger spring 64, and latch spring 66. Leaf spring 60 is received in cavity 67 in the slide portion 44 of base hub 43.

Hub leaf latch assemblies 54 and 56 automatically release respectively lower section 47 and upper section 45 of split hub 46 when the base hub shaft 44 moves from upper section 70 to lower section 72 of pole 11. Upper section 70 of pole 11 has a larger diameter $D_1$ than the diameter of lower section $D_2$. When plunger 62 passes from the larger diameter $D_1$ of upper section 70 of pole 11 to the smaller diameter $D_2$ of lower section 72 of pole 11, plunger 62 is pushed against lower section 72 by plunger spring 64. Movement of plunger 62 depresses leaf spring 60 and allows split hub 46 to pass over it because plunger spring 64 overrides lighter latch spring 66. Latch spring 66 maintains outward pressure on the leaf spring 60. Hub leaf latch assemblies 54 and 56 can also be manually operated to release lower section 47 and upper section 45 of split hub 46 by depressing leaf spring 60.

FIG. 5 illustrates multiple position rib assembly 12 of umbrella 10 in the second open position. Lower section 47 of split hub 46 is separated from upper section 45 of split hub 46. Control strut 22 extends vertically. Outer cantilevered assembly 16 is folded towards pole 11.

Figure 6:
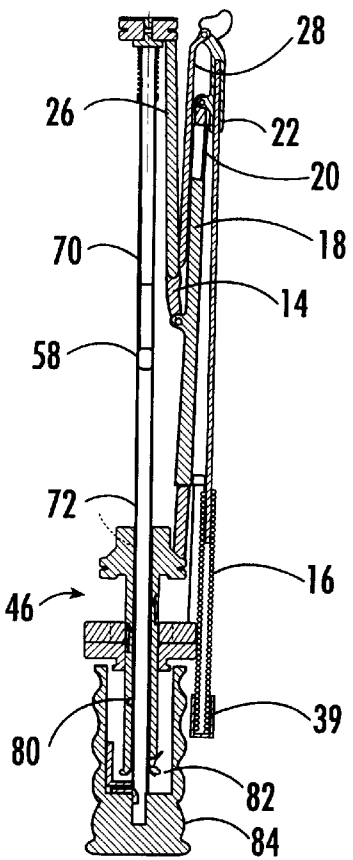
FIG. 6 is a cross-sectional view of the umbrella shown in FIG. 1 when the umbrella is in a closed position.

FIG. 6 illustrates multiple position rib assembly 12 of umbrella 10 in the closed position. Lower section 72 of pole 11 is telescoped within upper section 70 of pole 11. In this closed position, inner support assembly 14 and outer cantilevered assembly 16 collapse to fold against pole 11. Beam 26 is folded against upper section 72, link rod 28 is pivoted against beam 26. A portion of girder rod 18 and girder sleeve 20 also rest against beam 26. Inner support assembly 14 rests against girder sleeve 20 and the control strut 22. Button lever and pole extension release mechanism 80 locks umbrella 10 in the closed position. Hub slide assembly 42 is received in cavity 82 of handle 84.

In operation, upward movement of the base hub 43 on pole 11 opens umbrella 10 into the first open position shown in FIG. 1. Downward movement of the base hub 43 on pole 11 closes umbrella 10 into the closed position shown in FIG. 6. Umbrella 10 is closed from either the first open position or the second open position by pulling split hub upper section 45 to its lowest position on base hub shaft 44 which causes base hub toggle lock 48 to unlock hub slide assembly 42. Continuation of the downward pulling motion moves base hub 43 over pole extension latch 58 to collapse lower section 72 of pole 11 inside upper section 70 of pole 11.

To open umbrella 10 to rain position shown in FIG. 1, the user depresses button lever and pole extension release mechanism 80 and pushes upward on lower section 47 of split hub 46. The upward motion raises both upper section 45 and lower section 47 of split hub 46 to their highest position on the base hub shaft 44 to be engaged by leaf latch assemblies 54, 56. The upward motion also places hub slide assembly 42 at the top of upper section 72 of pole 11. Hub slide assembly 42 can be secured in place by raising base hub toggle lock 48. Opening umbrella 10 to the second open position is achieved in a similar manner except that the user pushes upward on upper section 45 of split hub 46. Lower section 47 of split hub 46 remains near the bottom the base hub shaft 44 when upper section 45 is secured by leaf latch 56.

In one embodiment, the flex strength of outer cantilevered assembly 16 of at least one multiple position rib assembly can be different than the flex strength of the outer cantilevered assembly 16 of any of the other rib assemblies.

Figure 7A:
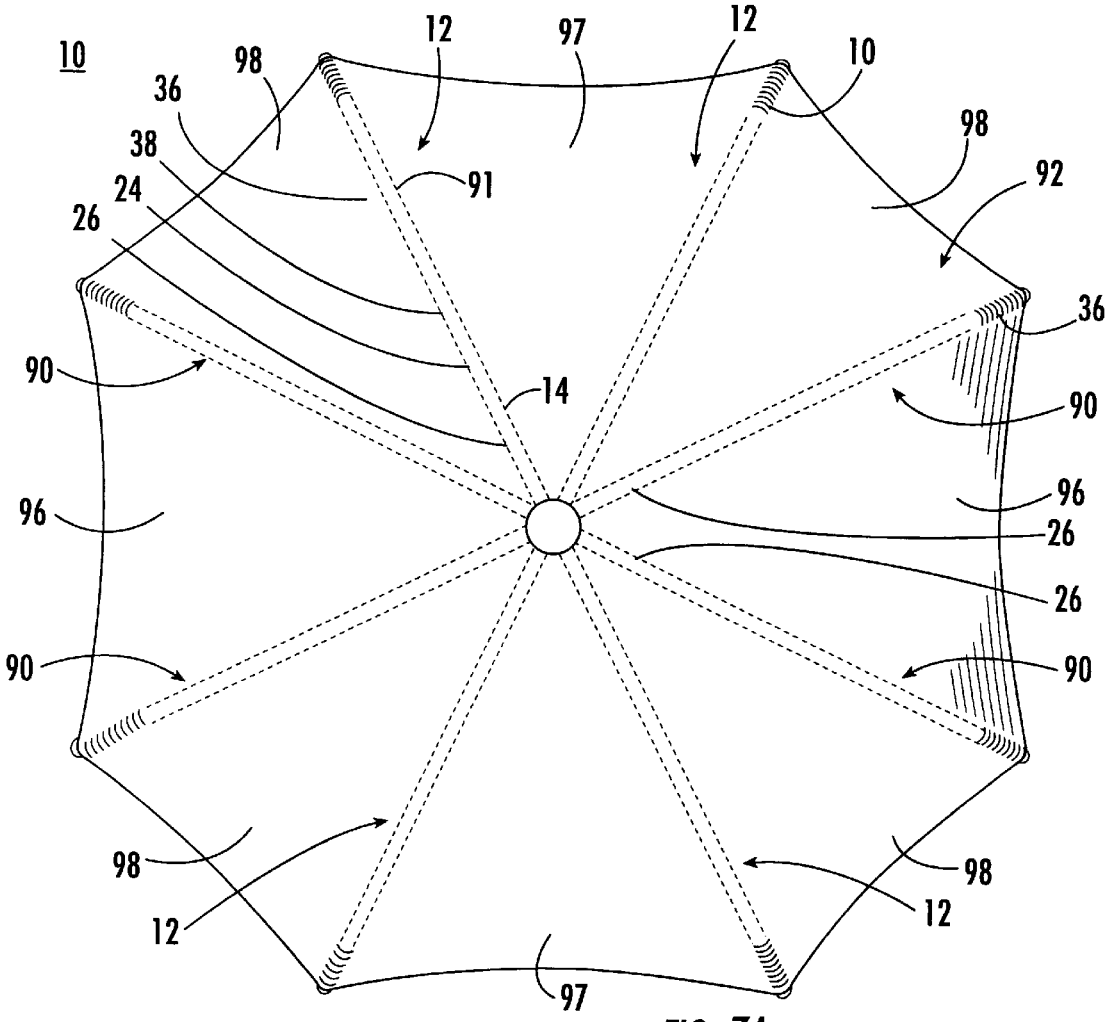
FIG. 7A is a top plan view of a canopy used with FIG. 1 with all ribs extended in the first open position.
Figure 7B:
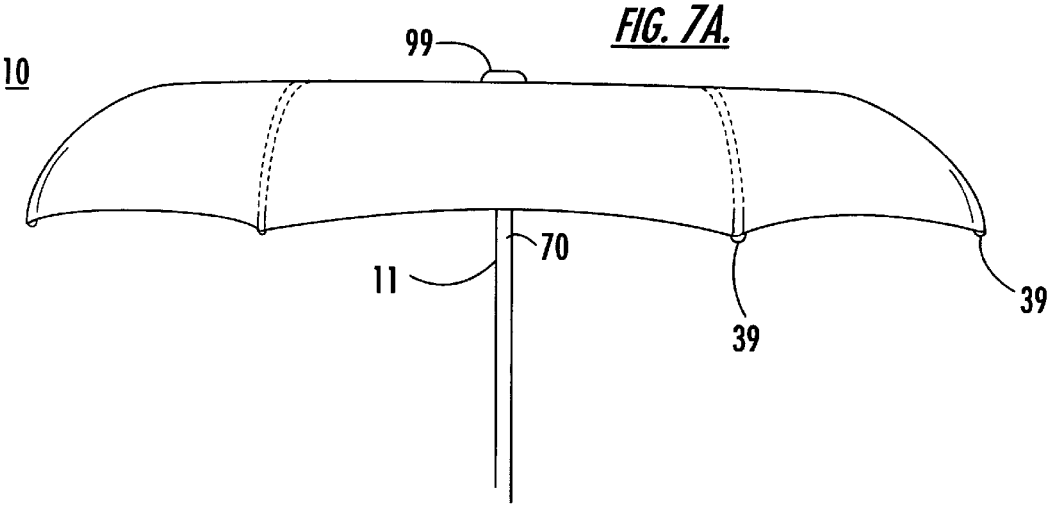
FIG. 7B is a side elevational view of the canopy shown in FIG. 7A.

FIGS. 7A and 7B illustrate umbrella 10 having multiple position rib assemblies 12 and single position rib assemblies 90 extended horizontally. Canopy cover 92 is in the first open position. Preferably, umbrella 10 includes four multiple position rib assemblies 12 and four single position rib assemblies 90. Single position rib assemblies 90 are identical in construction to the multiple position rib assembly 12 except that pivot joint 30 does not swivel. Canopy 92 can be attached to multiple position rib assemblies 12 and single position rib assemblies 90 with canopy tie down straps 94. Girder rods 18 of all eight preferred multi-position rib assemblies and single position rib assemblies can be attached pivotally to the base hub 43. Upper section 45 of split hub 46 can be pivotally attached to control struts 22 of each of the four preferred single position is rib assemblies 90. Lower section 47 of split hub 46 can be pivotally attached to control struts of each of the multiple position rib assemblies 12.

Horizontal panel 96 of canopy cover 92 extends between each pair of single position rib assemblies 90. Vertical panel 97 of canopy cover 92 extends between each pair of multi-position rib assemblies 12. Corner panel 98 of canopy 92 extends between an adjacent single position rib assembly 90 and a multi-position rib assembly 12. Center mount screw cap 99 secures canopy 92 to pole 11.

Figure 8A:
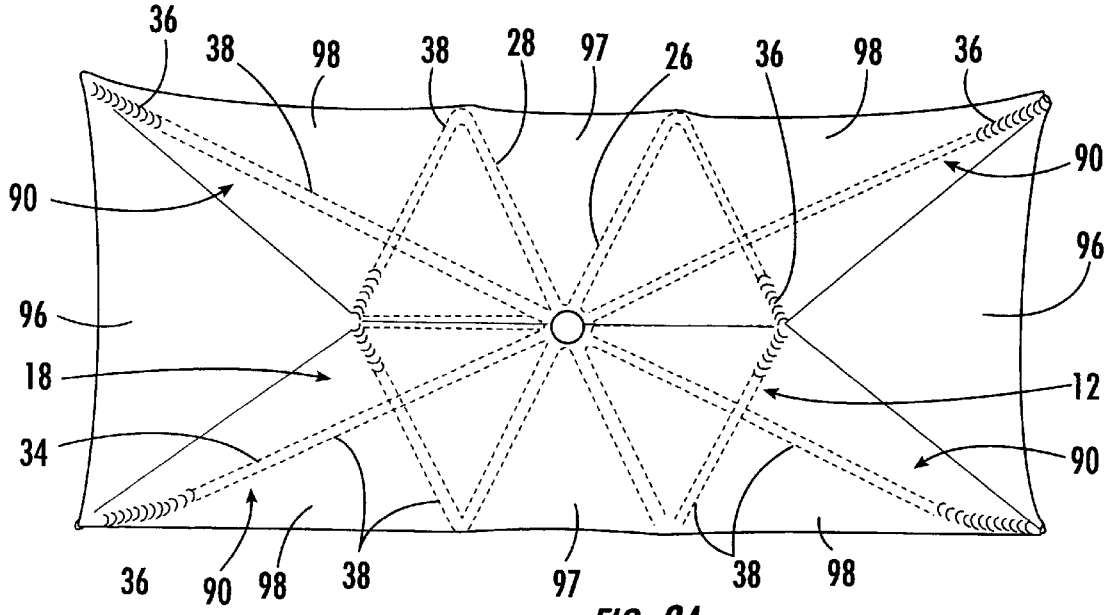
FIG. 8A is a top plan view of a canopy used with FIG. 1 in a second open position, the umbrella is open with four single position ribs extended and four multiple position ribs folded.
Figure 8B:
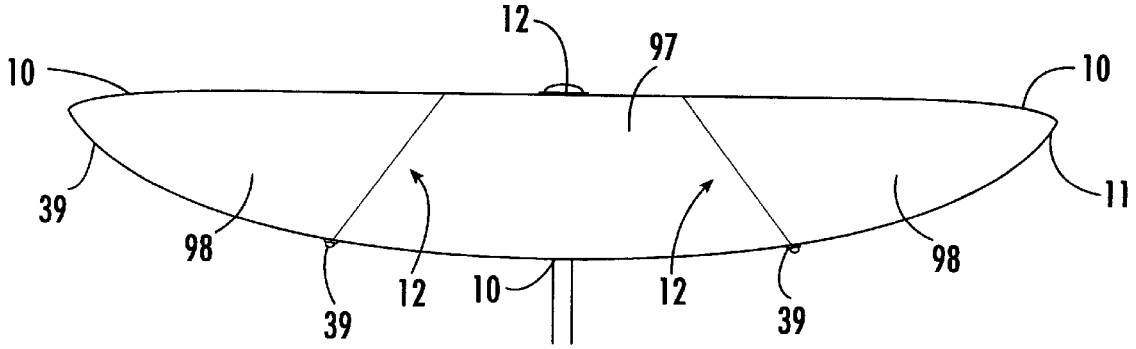
FIG. 8B is a side elevational view of the canopy shown in FIG. 8A.

FIGS. 8A and 8B illustrate umbrella 10 including canopy cover 92 in the second open position. Single position ribs 90 extend horizontally and the multiple position rib assemblies 12 are vertical.

When the umbrella 10 is in the second open position the outer cantilevered assembly 16 of four single position rib assemblies 90 have less curvature than in the first open position. When the multiple position rib assemblies are folded in the second open position the perimeter of canopy cover 92 is smaller than it is in the first open position, relaxing canopy 92 pressure on the four single position rib assemblies 90 causing them to flatten. Because outer rib section 36 is a flexible spring that will bend on contact with a car door's frame, umbrella 10 can fit windshields several inches narrower than the width of umbrella 10.

Figure 9:
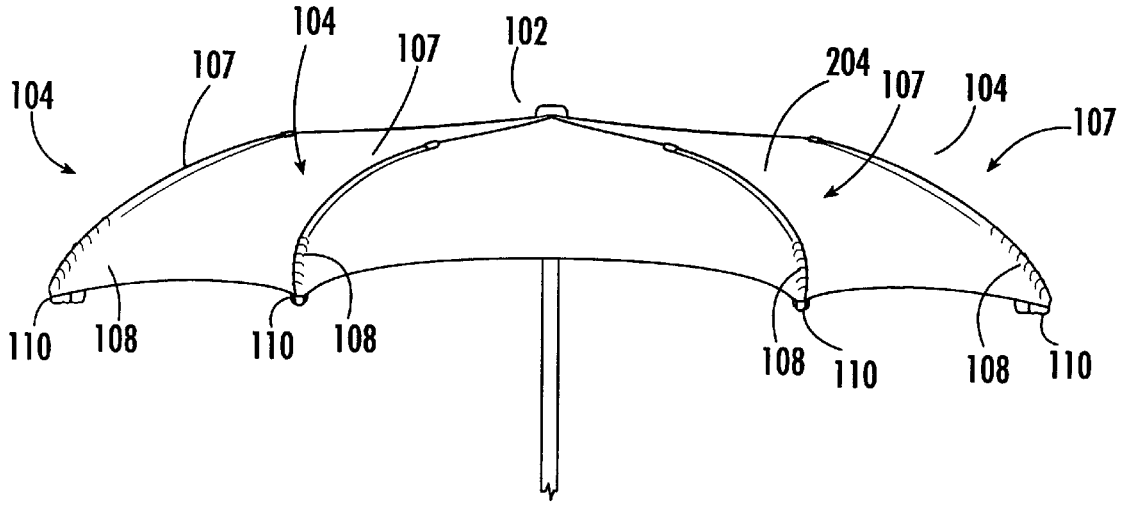
FIG. 9 is a side view of an alternate embodiment of this invention having a flattened dome and flexible skirt.

FIG. 9 illustrates a soft-skirted rain umbrella. This embodiment is conventional in purpose and operation. Rib placement and symmetry are also conventional. However, conventional rib design and construction are improved by this embodiment to soften the rib ends of the umbrella. As illustrated by FIG. 9 outer dome 102 is flattened and rib curvature rate accelerates at outer cantilevered portion 104 of ribs 106. Outer cantilevered portion 104 comprises inner section 107, outer section 108 and end cap 110. Inner section 107 is conventionally constructed with a uniform cross sectional profile. Outer section 108 is formed of a flexible coil spring with sufficient strength to maintain canopy 112 intended shape in use. End cap 110 can be formed of a resilient material.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

We claim:

1. In an umbrella having a pole and a canopy cover, said canopy cover having a convex shape; and a plurality of rib assemblies attached to said canopy and radially extending from said pole, each of said rib assemblies comprising an inner support assembly attached to an outer cantilevered assembly, the improvement, in combination therewith comprising:

said inner support assembly is rigid and said outer cantilevered assembly is flexible to provide sufficient force on said canopy cover to retain said canopy shape, wherein the flex strength of said outer cantilevered assembly of at least one of said rib assemblies changes along the length thereof.

2. The umbrella of claim 1 wherein said outer cantilevered assembly of at least one of said rib assemblies comprises an inner rib section attached to an outer rib section, said inner rib section having a different flex strength than the flex strength of said outer rib section.

3. The umbrella of claim 2 wherein said inner rib section has a first end connected to said inner support assembly and a second end attached to said outer rib section of said outer cantilevered assembly, said first end of said inner section being tapered towards said second end of said inner section, said flex strength of said rib assembly decreases with distance from said inner support assembly.

4. The umbrella of claim 2 wherein said inner rib section has a larger cross section area than the cross section area of said outer rib section.

5. The umbrella of claim 2 wherein said inner rib section is formed of a different material than the material of said outer rib section.

6. The umbrella of claim 2 wherein said outer rib section is a spring.

7. The umbrella of claim 2 wherein the flex strength of said outer cantilevered assembly of at least one of said rib assemblies differs from the flex strength of the outer cantilevered assembly of any of the other of said plurality of rib assemblies.

8. The umbrella of claim 2 wherein said canopy has a flattened dome and curvature of said rib assemblies accelerates at the end not attached to said pole.

9. An umbrella having a pole and a canopy cover, said canopy cover having a convex shape; and a plurality of rib assemblies attached to said canopy and radially extending from said pole, each of said rib assemblies comprising an inner support assembly attached to an outer cantilevered assembly, the improvement, in combination therewith comprising:

said plurality of rib assemblies include at least one multiple position rib assembly, said inner support assembly of said multiple position rib assembly comprises a control strut, a girder rod and a girder sleeve, said control strut having a first end coupled to said pole and a second end coupled to a first end of said girder sleeve, said girder sleeve having a second end attached to said outer cantilevered assembly, said girder rod having a first end coupled to said pole and a second end received in said girder sleeve and said girder sleeve is movable to be telescoping with said girder rod.

10. The umbrella of claim 9 wherein said inner support assembly of said multiple position rib assembly further comprises a link rod having a first end pivotally connected to a first end of said outer cantilevered assembly with a rib hinge, a second end of said link rod being coupled to first end of a beam and a first end of link hinge, a second end of said beam being coupled to said pole and a second end of said link hinge being attached to said girder rod through a slot in said girder sleeve, wherein when said link rod and said outer cantilevered portion are extended said rib hinge rests on said girder sleeve.

11. The umbrella of claim 10 wherein said plurality of rib assemblies includes at least one single position rib, said inner support assembly of said single position rib being the same as said inner support assembly of said multi-position rib.

12. The umbrella of claim 10 wherein said beam, said control strut and said girder rod are coupled to said pole with a hub slide assembly, said hub slide assembly comprising a base hub and a split hub having an upper section and a lower section, said girder rod of said multi-position rib assembly and said girder rod of said single position rib assembly being attached to said base hub, said control strut of said single position rib being attached to said upper section of said split hub, and said control strut of said multiple position rib assembly being attached to said lower section of said split hub, wherein positioning of said hub slide assembly allows said umbrella to be moveable between said first open position in which said multiple position rib assembly and said single position rib assembly are extended, said second open position in which said outer cantilevered assembly of said multiple position rib assembly is folded toward said pole and said single position rib assembly is extended and said closed position in which said inner support assembly and said outer cantilevered assembly of said multiple position rib assembly and said single position rib assembly are folded against said pole.

13. The umbrella of claim 12 wherein when said umbrella is in said first open position said upper section of said split hub is adjacent said lower section of said split hub.

14. The umbrella of claim 12 wherein when said umbrella is in said second open position, said upper section of said split hub is separated from said lower section of said split hub, and said control strut is in a vertical position.

15. The umbrella of claim 12 further comprising a base hub toggle lock for latching said hub slide assembly at any position along said pole.

16. The umbrella of claim 12 further comprising a first split hub latch assembly for latching said upper section of said split hub to said pole and a second hub latch assembly for latching said lower section of said split hub assembly to said pole.

17. The umbrella of claim 12 further comprising four single position rib assemblies and four multi-position rib assemblies.

* * * * *